US005117344A

United States Patent [19]

Perez

[11] Patent Number: 5,117,344

[45] Date of Patent: May 26, 1992

[54] ILLUMINATED BALLOON ASSEMBLY

[76] Inventor: Rafael Perez, 850 N. Miami Ave., Apt. 1809, Miami, Fla. 33131

[21] Appl. No.: 696,236

[22] Filed: May 6, 1991

Related U.S. Application Data

[63] Continuation-in-part of Ser. No. 674,794, Mar. 18, 1991, Pat. No. 5,075,830.

[51] Int. Cl.[5] ..... F21V 1/06

[52] U.S. Cl. ..... 362/352; 362/253; 362/190; 362/806; 446/220; 40/214

[58] Field of Search ..... 362/101, 96, 253, 352, 362/189, 190, 191, 806, 811; 40/559, 560, 594, 214; 446/220, 219, 222, 484, 485, 901

[56] References Cited

U.S. PATENT DOCUMENTS 2,557,383 6/1951 Kerwer ..... 40/214
3,672,083 6/1972 Moran ..... 446/220

FOREIGN PATENT DOCUMENTS 2004368 8/1971 Fed. Rep. of Germany ..... 446/220
2460517 2/1981 France ..... 446/220

*Primary Examiner*—Ira S. Lazarus
*Assistant Examiner*—Sue Hagarman
*Attorney, Agent, or Firm*—Malloy, Downey & Malloy

[57] ABSTRACT

An illuminated balloon assembly including a balloon having a main body disposed in surrounding relation to an interior gas chamber and a neck portion integrally formed therewith to facilitate filling of gas within the interior chamber. An electric lamp is fixedly attached to an outer surface of the balloon body so as to direct light through the interior chamber effectively illuminating a translucent design on at least a portion of the balloon body. A power source is electrically interconnected with the electric lamp for energizing thereof and may be attached to the balloon body in a combined unit with the electric lamp or separately on the end of an interconnecting stick or cord connected to and extending from the neck portion.

24 Claims, 4 Drawing Sheets

ILLUMINATED BALLOON ASSEMBLY

This is a continuation-in-part application of co-pending application Ser. No. 07/674,794, filed on Mar. 18, 1991; now U.S. Pat. No. 5,075,830.

BACKGROUND OF THE INVENTION

1. Field of the Invention

The present invention relates generally to illuminated balloons, and more specifically, to an illuminated balloon having a translucent design on at a least portion of the balloon wherein light directed into the interior of the balloon from an externally attached electric lamp effectively illuminates the design.

2. Description of the Related Art

Unlike many articles of manufacture, balloons have survived the test of time and continue to grow in popularity for use as gifts, displays, souvenirs, decorations, and the like. For years, balloons have been a source of visual enjoyment and entertainment, especially for children. Many times, balloons are filled with helium to make them float upwardly and may include a design or advertisement printed on an outer surface making the balloons an effective means for display. While latex balloons have been popular for many years, more recently, Mylar® balloons have also become quite popular, being formed of a non-latex material and usually having a chrome finish on at least one side with a design or message printed on the outer surface. Both Mylar® and latex balloons have been made to include popular animated characters printed on their outer surface and some are even formed into the shape of various characters or animals having extremities such as arms, legs, antennas, and the like attached thereto.

While most balloons, including the latex and the Mylar®-type balloons, are particularly attractive in the daylight or other bright, well-lit atmospheres, their attractiveness cannot be fully appreciated at night or in dark places such as at the circus, evenings sporting events, or simply outdoors during the evening hours. Unfortunately, these are the circumstances during which balloons are most often sold and meant to be enjoyed by the consumer and surrounding public.

There have been attempts in the past to illuminate balloons by inserting a light bulb into the interior of the balloon so as to achieve a glowing or illuminated effect. One such attempt is illustrated in the U.S. Patent to Marletta, U.S. Pat. No. 4,452,445, wherein an elongated housing having a light bulb attached to the upper end is inserted through the neck of the balloons as to position the light bulb within an interior portion of the balloon. The elongated housing extends downwardly out through the neck of the balloon and includes a switch attached at the bottom end.

Another related device is disclosed in the patent to Neumeier, U.S. Pat. No. 4,794,498, directed to an accessory device for an inflatable gas balloon, wherein a cup-shaped housing having a rim portion and a light bulb attached thereto is fitted within the balloon neck so as to position the light bulb in a lower portion of the balloon interior.

While the above devices may be useful for their intended purpose, they are considerably complex requiring various means to allow gas to escape from the balloon as heat is generated by the light bulb within the balloon interior. Further, the balloons in the above-referenced patents are limited to attachment with a stick or rigid elongate housing to which the light bulb is attached, and because many balloons are often filled with helium and allowed to float freely, this type of structure is not always desirable.

Accordingly, there still exists a need in the present balloon art for an illuminated balloon assembly adapted for use with virtually any known type of balloon wherein a light source is attachable to an outer surface of the balloon so as to direct light through an interior chamber thereof, illuminating the balloon and any design printed thereon.

It is, therefore, an object of the present invention to provide an illuminated balloon assembly, wherein a low voltage light bulb is affixed to an outer surface of a balloon, including a latex balloon or a Mylar® balloon, so as to effectively direct light through an interior chamber thereof in such a manner so as to at least partially illuminate the balloon and a design printed thereon.

It is another object of the present invention to provide an illuminated balloon having a translucent design printed on at least a portion of the surface thereof, wherein light directed from an electric lamp attached to an outer surface of the balloon effectively directs light through the balloon interior thereby illuminating the translucent design.

It is still a further object of the present invention to provide a Mylar® balloon have a 3.5 volt flashing electric lamp attached to an outer surface thereof, wherein light emitted from the bulb effectively illuminates a translucent design printed on at least one face of the balloon.

It is yet another object of the present invention to provide a latex balloon having a 3.5 volt flashing electric lamp attached to an outer surface thereof, wherein light emitted from the bulb effectively illuminates a translucent design printed thereon.

It is still a further object of the present invention to provide an illuminated balloon assembly which is relatively simple and inexpensive to manufacture making it marketable to a large percentage of the population.

These and other objects and advantages of the present invention will be more readily apparent from the description which follows.

SUMMARY OF THE INVENTION

The present invention is directed to an illuminated balloon assembly including a balloon having a main body and a neck portion integrally formed therewith, and a light assembly including an electric lamp attachable to an outer surface of the balloon body so that light emitted from the electric lamp is directed through an interior chamber of the balloon effectively illuminating the balloon and any design printed thereon.

In a first preferred embodiment of the present invention, the balloon is made of a non-latex material such as avoh, commonly known as Mylar®, and includes a front face and a rear face sealed together about a peripheral edge so as to enclose an interior gas chamber. The interior gas chamber can be filled with any conventionally known gas ordinarily used to fill balloons including helium or air.

The front face of the balloon can be either transparent or opaque with a substantially translucent design printed thereon. The rear face is preferably either transparent or may have a chrome finish on both its inner and outer surface.

The light assembly of the present invention comprises a small 3.5 volt flashing bulb electrically interconnected to a power source, and in the first preferred embodiment, a thin gauge electrical conductor is used. The conductor consists of a pair of positive and negative thin gauge wires intertwined with one another so as to define a cord extending between and electrically connecting to the battery pack and a socket which houses the flashing bulb. The flashing bulb is attached to the outer surface of either the front face or the rear face of the balloon using a decal made of opaque tape or similar material having an adhesive inner surface. The decal is adhered to the outer surface of the balloon in covering relation to the flashing bulb so as to maintain the bulb in a fixed, mounted position against the outer surface of the balloon. Preferably, the tape includes a highly reflective inner surface which is adapted to reflect light emitted from the bulb into the balloon interior.

In the first preferred embodiment of the present invention, the front face of the balloon is opaque and includes a substantially translucent design printed thereon. The rear face can be either clear or have a chrome finish. The flashing bulb is attached to a transparent area on the rear face so that light emitted from the bulb is directed through the interior of the balloon and onto an inner surface of the front face with at least a portion of light passing through the translucent design so as to effectively illuminate the design.

In an alternative embodiment of the first preferred embodiment of the present invention, the flashing bulb is attached to the front face, which may be either transparent or opaque, whereupon light emitted from the bulb is directed through the balloon interior and onto an interior or reflective surface of the rear face. Light reflected off of the inner surface of the rear face effective illuminates at least the design on the front face of the balloon.

In a second preferred embodiment of the present invention, the balloon is made of a latex material whereupon the light bulb is attachable to an outer surface thereof with the decal so as to effectively direct light through the interior chamber of the balloon, illuminating the balloon and any design printed thereon.

The light bulb may be energized by a battery within a battery pack or other similar power source which can be attachable to the balloon's outer surface in combination with the light bulb or at the end of an interconnecting cord or stick. In one embodiment, the interconnecting thin gauge wires serve as an attaching cord extending between the battery pack and the balloon, Wherein the battery pack serves as a handle means. In another embodiment, the battery pack is attachable to the end of a stick extending from the neck portion of the balloon with the interconnecting wires extending from the battery pack up the length of the stick and to the light bulb on the balloon's outer surface. Finally, in another embodiment, the light bulb and power source may be combined in a single unit which is adapted to be attached to the outer surface of the balloon using a reflective decal or other attachment means, thereby eliminating the need for wires extending between the bulb and a separate battery pack unattached to the balloon.

The invention accordingly comprises the features of construction, combination of elements, and arrangement of parts which will be exemplified in the description hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
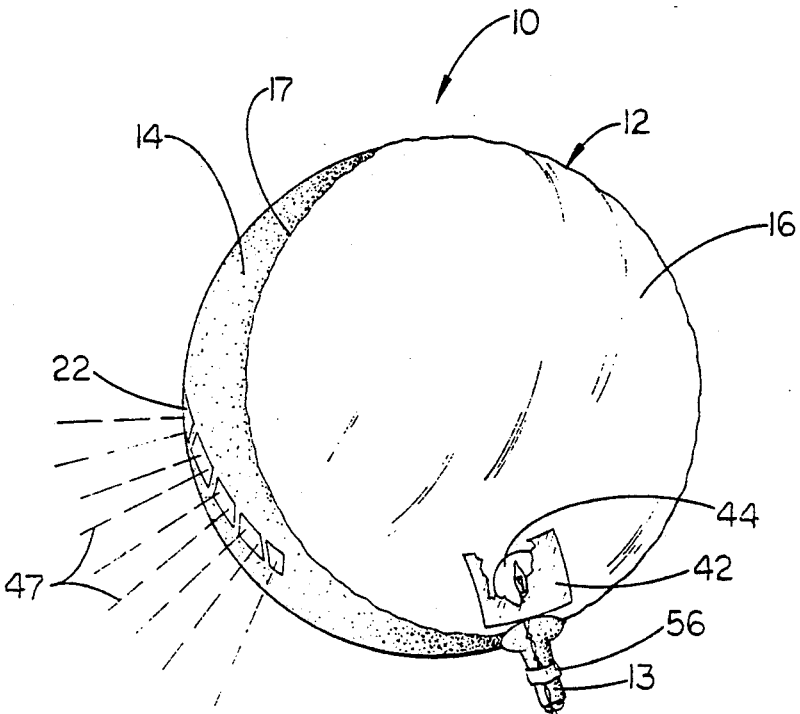
FIG. 1 is a perspective view of a first preferred embodiment of the illuminated balloon assembly of the present invention.
Figure 2:
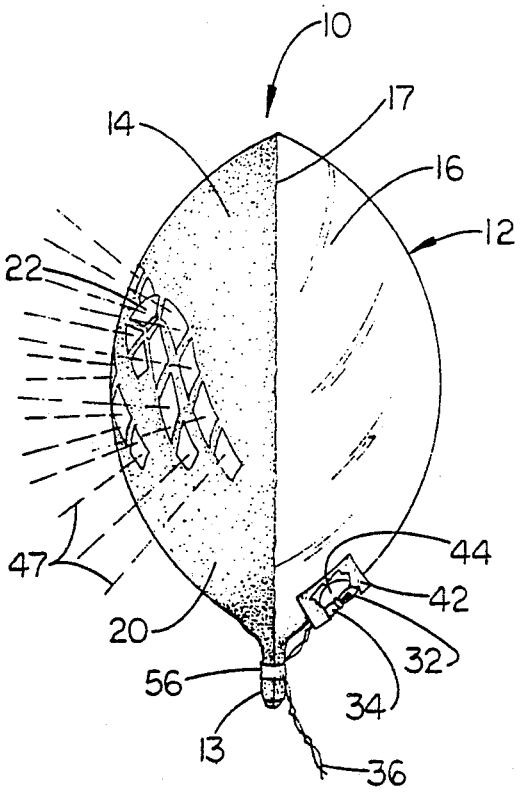
FIG. 2 is a side plan view of the embodiment of FIG. 1.

Referring initially to FIG. 1, the present invention is directed to an illuminated balloon assembly generally indicated as 10. In a first preferred embodiment, a balloon 12 includes a front face 14 and a rear face 16 sealed together about a seam 17 along correspondingly positioned peripheral edges thereof. In the first preferred embodiment as illustrated in FIGS. 1 and 2, the front face 14 of the balloon 12 includes a substantially opaque portion 20 and a substantially translucent design printed thereon, wherein the translucent design is adapted to allow at least partially passage of light therethrough. The rear face 16 of the balloon 12 can be either transparent or opaque or may include a chrome finish both on its inner and outer surface.

Figure 3:
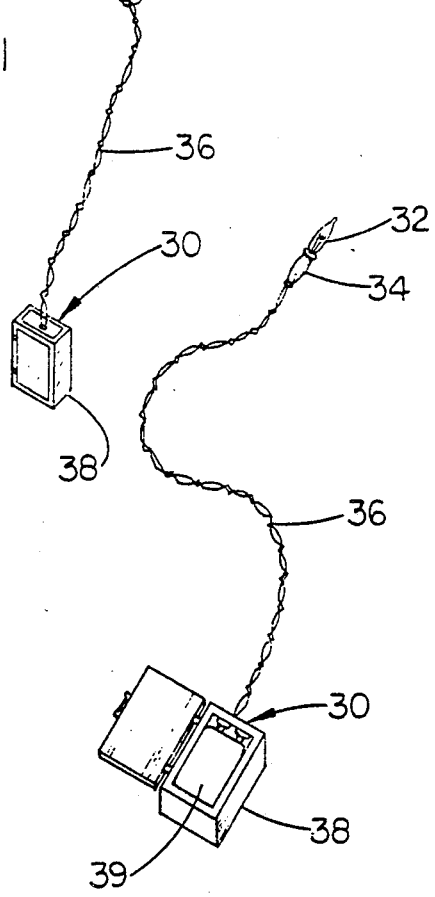
FIG. 3 is a perspective view of the one embodiment of the light assembly of the present invention.
Figure 4:
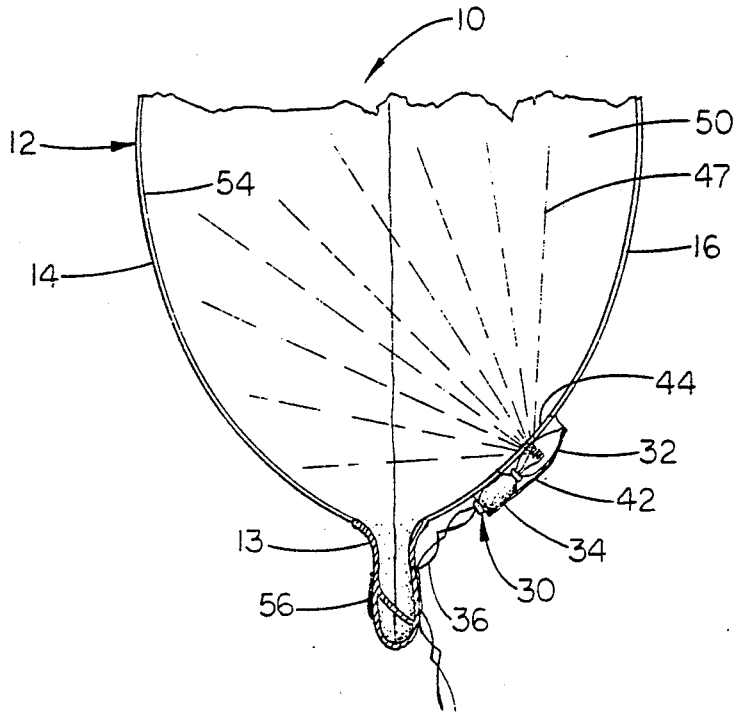
FIG. 4 is a cutaway view in partial section illustrating light being emitted from the light assembly into the balloon interior.
Figure 5:
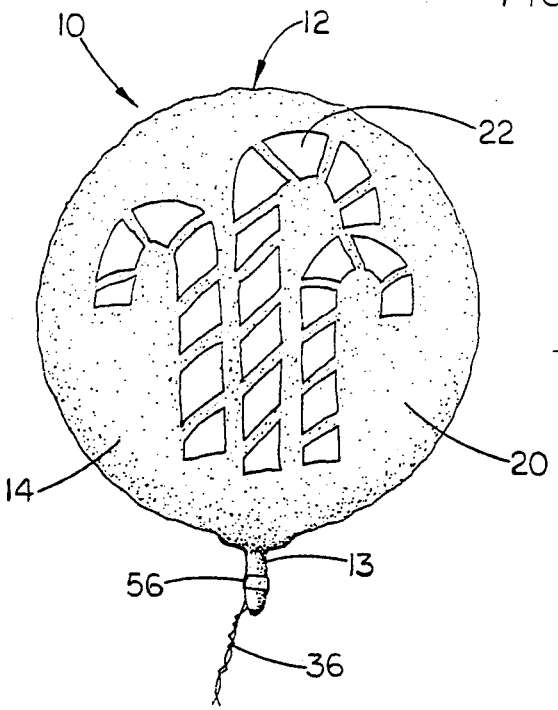
FIG. 5 is a front plan view of the embodiment of FIG. 1.

An important feature of the present invention is a light assembly, generally indicated as 30, and in FIGS. 1 and 3, a first embodiment is shown wherein the light assembly 30 includes a 3.5 volt flashing light bulb 32 housed within and electrically interconnected to a receiving socket 34. An electrical conductor 36, comprising a pair of relatively thin gauge wires intertwined with one another, extends between and is integrally connected to the socket 34 and a battery pack 38 which houses a conventional battery 39 therein for supply power to the light bulb 32. As seen in FIG. 1, the light bulb 32 and socket 34 are fixedly attached to an outer surface of the balloon 12 by means of a decal 42 generally formed of an opaque tape. In the instance the face to which the light bulb is to be attached is either opaque or of a chrome finish, then a clear, transparent area 44 is provided with the light bulb 32 being positioned in adjacent relation thereto so that light 47 emitted from the bulb is effectively dispersed into an interior gas chamber 50 of the balloon, as illustrated in FIG. 4. At least a portion of the light 47 is directed onto an inner surface 54 of the front face 14 and out through the translucent design 22 as shown in FIGS. 1 and 2.

The electrical conductor 36 extending between the socket 34 and the battery pack 38 is preferably attached to a neck portion 13 of the balloon 12 by tape 56 or other like attachment means. Ordinarily, the interior gas chamber 50 of the balloon 12 is filled with helium so that the balloon 12 has a tendency to float upwardly. In this instance, the electrical conductor 36 would serve as a connecting cord between the balloon 12 and the battery pack 38. The battery pack 38 also provides an ideal handle means for the user to grasp as a balloon 12 floats upwardly away in a preferred, displayed orientation.

Figure 6:
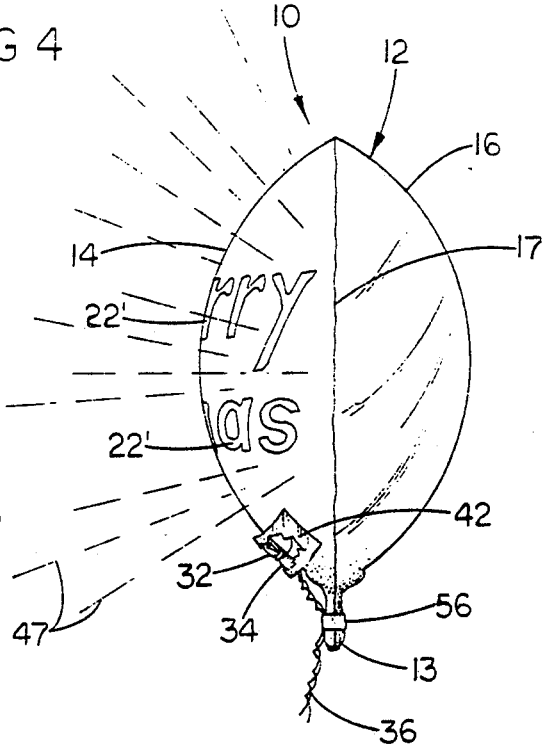
FIG. 6 is a side plan view illustrating the light assembly attached to a front face of the balloon with the light reflecting off of an inner surface of the rear face and out through the front face.

An alternative to the first preferred embodiment is illustrated in FIG. 6, whereupon the light bulb 32 and socket 34 are mounted to the front face 14 of the balloon which is transparent and includes the translucent design 22' thereon. In this particular embodiment, the rear face 16 preferably includes a chrome finish on both the inner and outer surface thereof, whereupon light directed from the light bulb 32 is directed through the interior gas chamber 50, reflecting off of the inner surface of the rear face 16 and out through the transparent translucent design 22' thereon.

Figure 7:
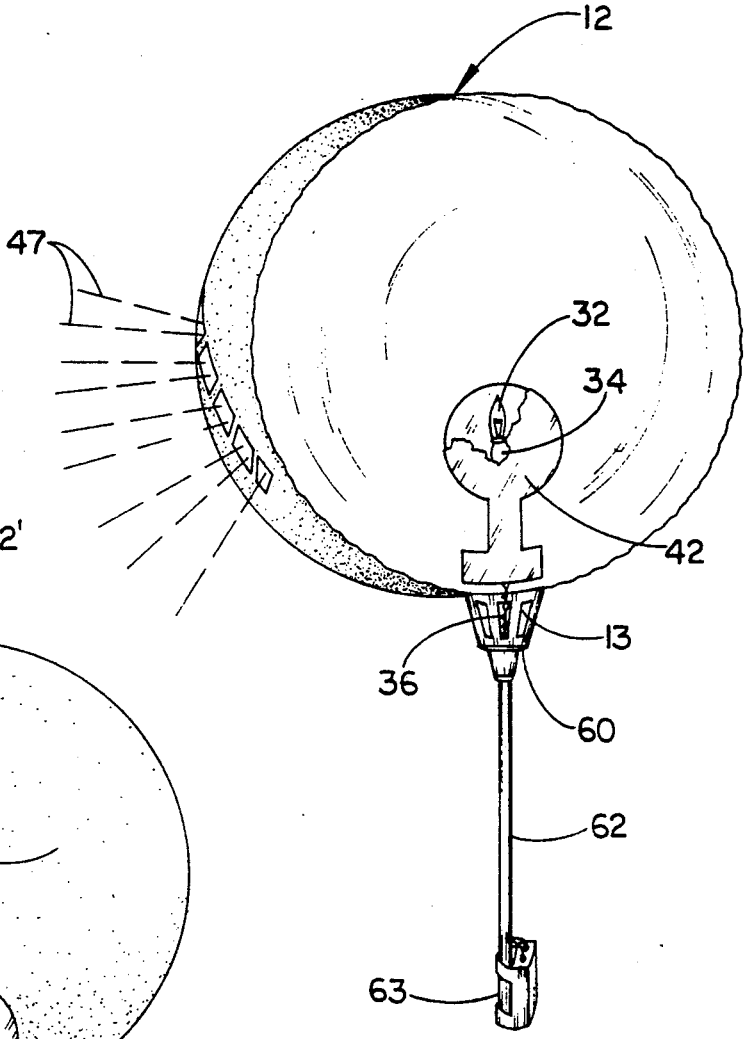
FIG. 7 is a perspective view of the present invention wherein an elongated stick is interconnected with a neck portion of the balloon with the battery pack attached to an end thereof.

Another alternative to the first preferred embodiment is illustrated in FIG. 7 in which an attachment cap 60 is attachable to the neck portion 13 of the balloon 12 in elongate stick or rod 62 extending downwardly therefrom serving as a handle means. In this embodiment, the battery pack 38 is attached to a free distal end 63 of the 62 serving as an ideal location for grasping by the user.

Figure 8:
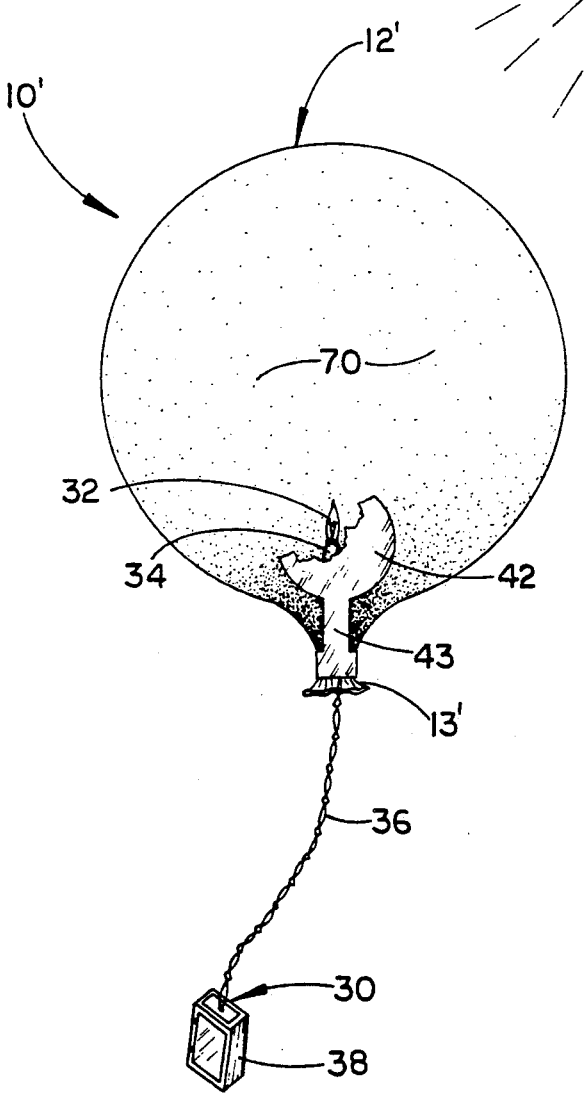
FIG. 8 is a perspective view illustrating one embodiment of the light assembly of the present invention attached to a latex balloon.

Referring to FIG. 8, the light assembly 30 is shown in attachment with a latex balloon 12' wherein the decal 42 attaches the light bulb 32 and socket 34 to an outer surface of the latex balloon 12'. An extended T-member 43 of the decal 42 extends down to and around a neck portion 13' of the balloon 12' in covering relation to the electrical conductor 36.

Figure 9:
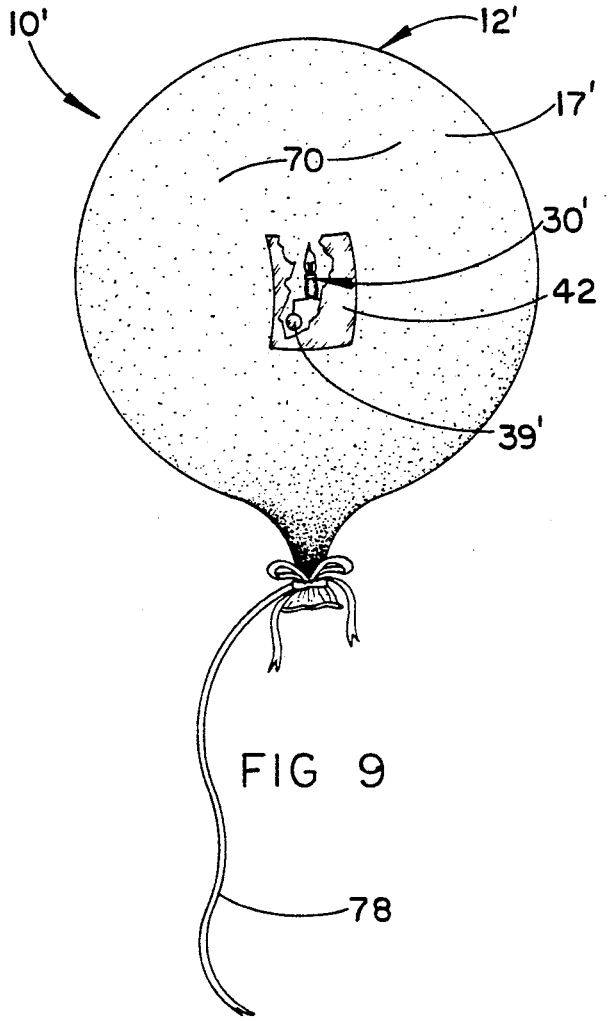
FIG. 9 is a perspective view illustrating an alternative embodiment of the light assembly attached to a latex balloon.
Figure 10:
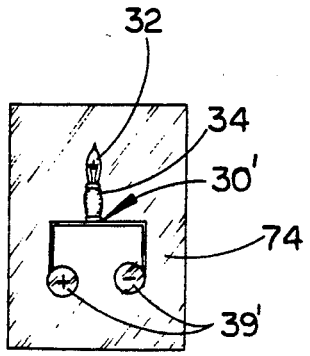
FIG. 10 is an isolated view of the light assembly shown in FIG. 9.
Figure 11:
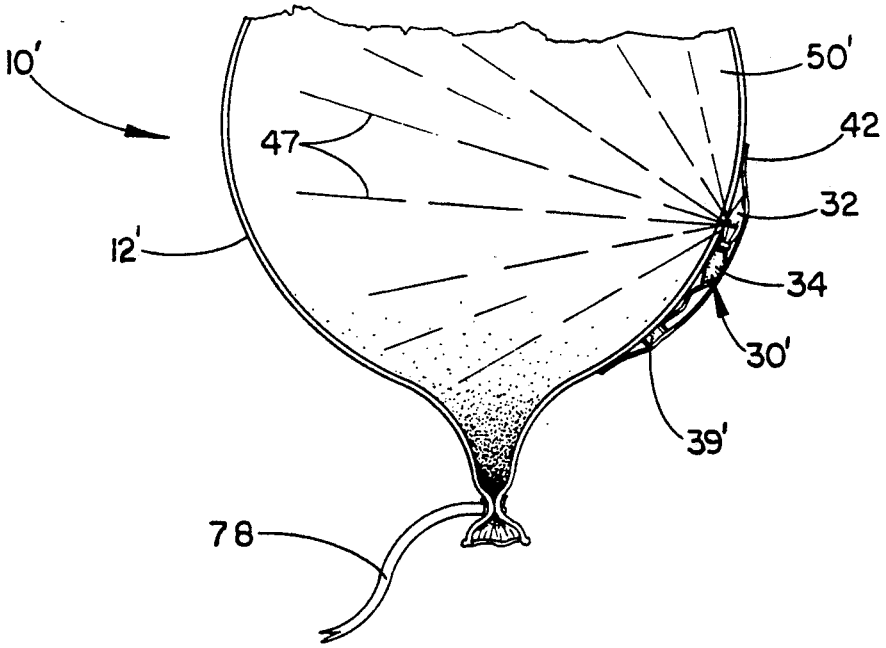
FIG. 11 is a cutaway view in partial section illustrating light being emitted from the light assembly of FIG. 9 into an interior chamber of the latex balloon of FIG. 9.

In FIG. 9, an alternative embodiment of the light assembly 30' is shown in attachment with the latex balloon 12'. In the embodiment of the light assembly 30', the light bulb 32, socket 34, and electrically interconnected power source 39' are all attached to an outer surface 70 of the balloon 12' using decal 42. As best illustrated in FIG. 10, the power source 39' provides a positive and negative current flow to the socket 34 thereby energizing the light bulb 32. The decal 42 is positionable in covering relation to the light bulb 32, socket 34, and power source 39' and preferably includes an inner reflective surface 74 which is adapted to reflect light from the bulb 32 through the balloon 12' and into an interior gas chamber 76, as seen in FIG. 11. In this manner, a latex balloon 12' filled with helium and having a string or ribbon 78 attached thereto can be illuminated simply by attaching the light assembly 30' to the outer surface 70 of the balloon 12' using the decal 42. As seen in FIG. 11, the light 47 will be directed through the interior chamber 50', effectively illuminating the balloon.

While the present invention has been disclosed in connection with the preferred embodiment, it should be understood that there may be other embodiments which fall within the spirit and scope of the invention as defined by the following claims.

What is claimed is:

1. An illuminated display assembly, comprising:

a balloon having an inflatable body and a neck portion integrally formed therewith, said inflatable body disposed in air tight, sealed relation about a hollow interior gas chamber, an electric lamp fixedly attached to an outer surface of said inflatable body and structured and disposed to direct light into said interior gas chamber and at least partially out through said inflatable body, thereby effectively illuminating said balloon, means to attach said electric lamp to said outer surface of said inflatable body, said means to attach said electric lamp to said outer surface of said inflatable body including an opaque tape adapted to be disposed in covering relation to said electric lamp, so as to effectively attach said electric lamp to said outer surface of said inflatable body, said opaque tape including a highly reflective inner surface adapted to substantially reflect said light emitted from said electric lamp into said interior gas chamber, and power supply means.

2. An illuminated display assembly, comprising:

a balloon having an inflatable body and a neck portion integrally formed therewith, said inflatable body disposed in air tight, sealed relation about a hollow interior gas chamber, a translucent design printed on at least a portion of said inflatable body, an electric lamp fixedly attached to an outer surface of said inflatable body and structure and disposed to direct light into said interior gas chamber and at least partially out through said translucent design, thereby effectively illuminating said translucent design, attachment means for attaching said electric lamp to said outer surface of said inflatable body, said attachment means including an opaque tap adapted to be disposed in covering relation to said electric lamp, so as to effectively attach said electric to said outer surface of said inflatable body, said opaque tape including a highly reflective inner surface adapted to substantially reflect said light emitted from said electric lamp into said interior gas chamber, a power source, and means to contain said power source therein and electrically interconnected to said electric lamp for energizing thereof.

3. An assembly as in claim 1 or 2 wherein said inflatable body is formed of a latex material.

4. An assembly as in claim 3 wherein said electric lamp comprises a 3.5 volt bulb electrically interconnected to and seated within a socket.

5. An assembly as in claim 4 wherein said power supply container means includes a battery container structured to contain a battery therein and electrically interconnected to said electric lamp by a substantially thin gauge conductor wires.

6. An assembly as in claim 5 wherein said battery pack defines a handle portion to facilitate holding of the display apparatus, said electrical conductor wires defining a connecting cord extending between said battery pack and said balloon.

7. As assembly as in claim 4 wherein said electric lamp is interconnected with a power source in a combined unit wherein said electric lamp and said power source are attachable to said outer surface of said inflatable body.

8. An assembly as in claim 1 or 2 wherein said inflatable body is formed of a non-latex material.

9. An assembly as in claim 8 wherein said inflatable body includes a front face and a rear face sealed together substantially about an outer peripheral edge in surrounding, sealed relation to said hollow interior gas chamber.

10. An assembly as in claim 9 wherein said electric lamp comprises a 3.5 volt bulb electrically interconnected to and seated within a socket.

11. An assembly as in claim 10 wherein said front face and said rear face are formed of a transparent material.

12. An assembly as in claim 10 wherein said translucent design is disposed on both said front face and said rear face.

13. An assembly as in claim 10 wherein said transparent design is disposed on said front face.

14. An assembly as in claim 13 wherein said rear face is formed of a substantially transparent, non-latex material.

15. An assembly as in claim 13 wherein said rear face is formed of a substantially opaque, non-latex material.

16. An assembly as in claim 13 wherein said electric lamp is attached to said outer surface of said rear face so as to effectively direct said light through said interior gas chamber and substantially through said translucent design on said front face.

17. An assembly as in claim 13 wherein said power source container means includes a battery pack structured to contain a battery therein and electrically interconnected to said electric lamp by a substantially thin gauge conductor wires.

18. An assembly in claim 13 wherein said battery pack defines a handle portion to facilitate holding of the display assembly, said electrical conductor wires defining a connecting cord extending between said battery pack and said balloon.

19. An assembly as in claim 13 wherein said electric lamp is electrically interconnected to a power supply in a single unit wherein said electric lamp and said power supply are both attachable to said outer surface of said inflatable body.

20. An assembly as in claim 15 wherein said rear face includes a highly reflective chrome finish on an inner surface and an outer surface thereof.

21. An assembly as in claim 20 wherein said electric lamp is attached to an outer surface of said front face so as to effectively direct said light through said interior gas chamber and onto said chrome finish on said inner surface of said rear face, wherein said light is reflected off of said inner surface of said rear face and dispersed throughout said interior gas chamber and at least partially out through said translucent design on said front face.

22. An assembly as in claim 20 wherein said power source container means includes a battery container structured to contain a battery therein and electrically interconnected to said electric lamp by a substantially thin gauge conductor wires.

23. An assembly as in claim 20 wherein said battery pack defines a handle portion to facilitate holding of the display apparatus, said electrical conductor wires defining a connecting cord between said battery pack and said balloon.

24. An assembly as in claim 20 wherein said electric lamp is electrically interconnected to a power supply in a single unit wherein said electric lamp and said power supply are both attachable to said outer surface of said inflatable body.

* * * * *